United States Patent [19]

Hoffmanner et al.

[11] Patent Number: 4,526,551

[45] Date of Patent: Jul. 2, 1985

[54] PRODUCTION OF ELECTRODES

[75] Inventors: Albert L. Hoffmanner, Worthington; Sheldon L. Semiatin, Columbus; Richard S. Podiak, Maumee, all of Ohio

[73] Assignee: Champion Spark Plug Company, Toledo, Ohio

[21] Appl. No.: 547,956

[22] Filed: Nov. 2, 1983

Related U.S. Application Data

[63] Continuation-in-part of Ser. No. 154,884, May 30, 1980, abandoned, and Ser. No. 398,413, Jul. 14, 1982, abandoned, which is a continuation of Ser. No. 286,980, Jul. 27, 1981, abandoned, which is a continuation of Ser. No. 84,596, Oct. 15, 1979, abandoned.

[51] Int. Cl.[3] ..... H01T 21/02

[52] U.S. Cl. ..... 445/7; 445/49; 72/258; 313/141

[58] Field of Search ..... 445/7, 49; 72/258; 29/422, 511; 313/141

[56] References Cited

U.S. PATENT DOCUMENTS

| | | | |
|---|---|---|---|
| 1,521,732 | 1/1925 | Thomas | 313/144 |
| 1,789,078 | 1/1931 | McElroy | 313/142 |
| 2,849,788 | 9/1958 | Creek | 29/422 |
| 2,945,293 | 7/1960 | Last | 29/422 |
| 2,954,495 | 9/1960 | Zeller . | |
| 2,955,222 | 10/1960 | Beesch | 447/7 |
| 3,040,417 | 6/1962 | Newton | 29/156.7 |
| 3,548,239 | 12/1970 | Eaton | 445/7 |
| 3,548,472 | 12/1970 | Urushiwara et al. | 445/7 |
| 3,643,322 | 2/1972 | Gerstle | 72/367 |
| 3,803,892 | 4/1974 | Yamaguchi et al. | 445/7 |
| 3,818,555 | 6/1974 | Yamaguchi et al. | 445/7 |
| 3,857,145 | 12/1974 | Yamaguchi et al. | 445/7 |

FOREIGN PATENT DOCUMENTS 1052781 3/1959 Fed. Rep. of Germany .

*Primary Examiner*—Kenneth J. Ramsey
*Attorney, Agent, or Firm*—John C. Purdue; David C. Purdue

[57] ABSTRACT

A method for producing a composite spark plug electrode is disclosed. The method comprises forming a first metal into a cup having an open end, a closed end and a wall surrounding a central opening which extends a distance z from the closed end to the open end. The method also comprises forming, from a second and different metal, a right circular cylindrical core sized to be received in the central opening in close fitting relationship with the wall therearound, and extending from the closed end toward the open end a distance less than z, and positioning the core in the central opening, thereby forming a composite billet having first and second ends corresponding, respectively, with the open and closed ends of the cup. Finally, a portion of the composite billet is extruded, second end first, through an extrusion orifice of a die with a force applied to the first end of the composite billet by an end of a tool. The force is applied so as to maintain substantial contact between the core and the closed end of the cup while extrusion is occurring.

23 Claims, 24 Drawing Figures

PRODUCTION OF ELECTRODES

CROSS-REFERENCE TO RELATED APPLICATIONS

This is a continuation-in-part of each of two applications, namely, Ser. No. 154,884, filed May 30, 1980 (abandoned), and Ser. No. 398,413, filed July 14, 1982 (abandoned), the latter being in turn, a continuation of Ser. No. 286,980, filed July 27, 1981 (abandoned), as a continuation of Ser. No. 84,596, filed Oct. 15, 1979 (abandoned).

BACKGROUND OF THE INVENTION

1. Field of the Invention

This invention relates to an improved method for producing a composite center electrode for a spark plug. The electrode is composed, for example, of a nickel alloy sheath with a copper core.

2. Description of the Prior Art

U.S. Pat. No. 3,144,576 granted Aug. 11, 1964 to Eugen Hagmaier et al. discloses a method for producing a composite center electrode by superposing a right circular cylindrical plate of a metal of good thermal conductivity, such as copper, on a right circular cylindrical plate of corrosion-resistant metal, such as nickel, within a die and extruding the plates therethrough to form a rod having a core of good thermal conductivity within a corrosion-resistant shell. The primary disadvantage of this method is that the length of the rod is limited because the core is formed with a taper which causes a correspondingly reduced thickness in walls of the shell as the metal plates are being extruded. This makes it impossible to assure uniform heat conductivity.

U.S. Pat. No. 3,548,472 granted Dec. 22, 1970 to Hisashi Urushiwara et al. discloses a method for producing a composite center electrode by subjecting a right circular cylindrical billet of corrosion-resistant metal to successive extrusions and drawings to form an elongated cup having a cavity extending therein, extruding a right circular cylindrical billet of a metal of a relatively higher thermal conductivity to form a core having a headed portion with a diameter equal to that of the elongated cup and a protruding portion of reduced diameter slightly less than that of the cavity, inserting the protruding portion of the core into the cavity and pressing the core therein to form an integral rod which is then subjected to heat diffusion. A composite center electrode is then formed by cold working the rod to form a head thereon. Both the elongated cup and the core are worked separately to dimensions substantially the same as their final dimensions before heat diffusion. Although this method produces a rod having a core of uniform diameter within a shell having walls of uniform thickness, the use of successive extrusions and drawings to form the elongated cup is uneconomical for mass production.

U.S. Pat. No. 3,857,145 granted Dec. 31, 1974 to Terumoto Yamaguchi et al. discloses a method for producing a composite center electrode by forming a cup from nickel or other corrosion-resistant metal, forming a cap having a headed portion with a diameter equal to the exterior diameter of the cup and a protruding portion of reduced diameter slightly less than that of the cup cavity of copper or of another metal of good thermal conductivity, inserting the protruding portion of the cap into the cavity of the cup, partially extruding the cup with the cap inserted therein through a die to form what the patent calls "a center electrode with a head". A rod having a core of uniform diameter within a shell having walls of uniform thickness is then cut from the "center electrode with a head" leaving, as scrap, the head and a part of the shell with a core therein. The head and the core are copper or the like while the shell part is nickel or the like. Finally, a composite center electrode is formed by cold working the rod to form a head thereon.

BRIEF DESCRIPTION OF THE INVENTION

The instant invention is based on the discovery of an improved method for producing a composite center electrode for a spark plug from a billet of copper or other metal of good thermal conductivity and a cup of nickel or other corrosion-resistant metal. The improvement involves confining the billet within the cup to produce an electrode blank wherein the copper is encapsulated, at least partially, by the nickel. Specifically, in one embodiment, the improvement involves controlling the positions and the relative sizes of the billet and of the cup so that the former fits tightly within the cup wall adjacent the closed cup end, but terminates short of the open cup end so that the cup wall extends thereabove at the open cup end. The composite billet having a recessed copper core is placed, closed cup end first, in the bore of a die having an extrusion orifice therein. A punch is then advanced into contact with the open end of the composite billet to cause extrusion but, before extrusion occurs, the punch causes the portion of the cup wall which extends above the billet to thicken radially inwardly, thereby confining the billet within the cup and effecting partial encapsulation of the former by the thickened wall of the latter. In another embodiment, the composite billet having a recessed core is partially extruded by a force applied by a plunger which carries a stud having a diameter equal to the diameter of the core. In this embodiment, the cup wall is prevented by the stud from thickening radially inwardly. Another embodiment, wherein the billet is fully encapsulated, was invented solely by Richard S. Podiak and is disclosed and claimed in co-pending application Ser. No. 459,179, filed Jan. 19, 1983, now abandoned, which application is a continuation of application Ser. No. 154,884, filed May 30, 1980. This embodiment is also disclosed herein and involves rolling the portion of the cup wall which extends above the billet radially inwardly prior to extrusion.

The method includes the additional improvement wherein the closed end of the composite billet having a recessed copper core is first inserted into a die having a stepped bore including an upper bore in which the billet fits closely and an extrusion orifice of reduced diameter and is then forced completely through the extrusion orifice to form an unheaded composite electrode blank wherein the metal of the cup completely encapsulates the copper core. An embodiment in which the unheaded composite electrode blank is partially extruded to produce a headed electrode is also disclosed. This embodiment was invented solely by Richard S. Podiak and is disclosed and claimed in co-pending application Ser. No. 459,179, now abandoned.

OBJECTS OF THE INVENTION

It is an object of the invention to provide a method for producing a headed composite spark plug electrode by a small number of cold working steps to make mass production thereof economically feasible.

It is a further object of the invention to provide a method for producing a headed composite center electrode for a spark plug whereby the copper is encapsulated, at least partially, by the nickel.

It is a further object of the invention to provide a method for producing an unheaded composite center electrode for a spark plug in which the copper is completely encapsulated by the nickel.

DETAILED DESCRIPTION OF THE INVENTION

Figure 1:
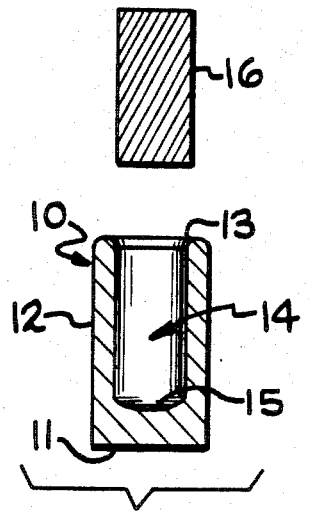
FIG. 1 is a partially schematic, vertical sectional view showing a corrosion-resistant metal cup and a right circular cylindrical billet of metal of high thermal conductivity prior to being inserted into the cup.
Figure 2:
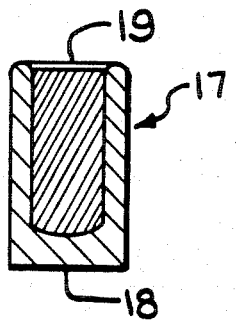
FIG. 2 is a sectional view showing a composite billet formed from the cup and billet of FIG. 1.

Referring now in more detail to the drawings, and, in particular to FIG. 1, one method according to the instant invention involves first forming a cup 10 from a corrosion-resistant metal, such as nickel. The cup 10 has a closed end 11, a wall 12 extending upwardly from the closed end 11 to an open end 13 and a cavity 14 extending concentrically therein to a curved lower surface 15. A right circular cylindrical billet 16 of copper or another metal having a high thermal conductivity is then positioned interiorly of the cup 10; the billet 16 fits tightly within the cup wall 12 to form a composite billet, which is indicated generally at 17 in FIG. 2. The composite billet 17 has a closed end 18 and a filled end 19. The copper or the like of the composite billet 17 is shown in FIG. 2 as having a curved surface which abuts and matches the curved surface 15 of the cup 10; this matching curved surface can be formed by compressing the right circular cylindrical billet 16 within the cavity 14 of the cup 10. Such compression also forces the copper or the like into close-fitting relationship with the interior of the wall 12 of the cup 10.

Figure 3:
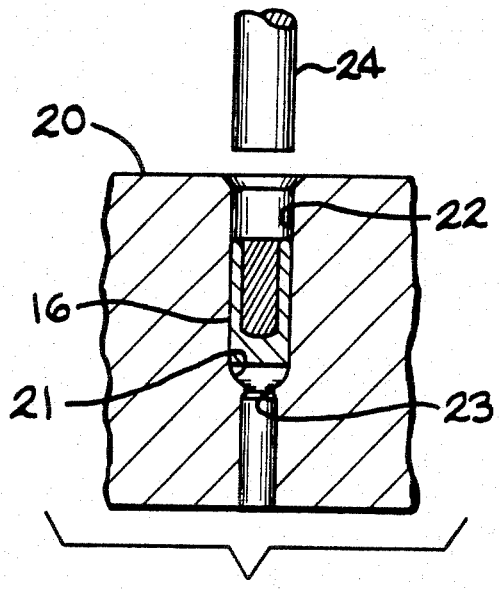
FIG. 3 is a partially schematic, vertical sectional view showing the composite billet of FIG. 2 inserted into a bore of a die having within the bore an extrusion orifice.
Figure 4:
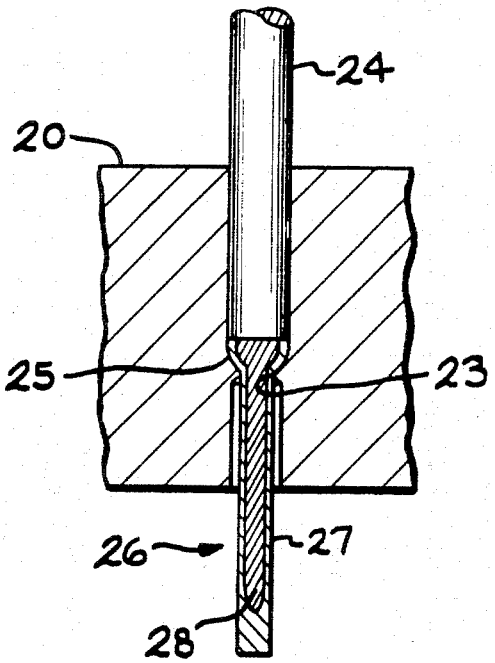
FIG. 4 is a sectional view showing an electrode blank formed from the composite billet of FIG. 3 after all except a terminal portion thereof is forced through the extrusion orifice.
Figure 23:
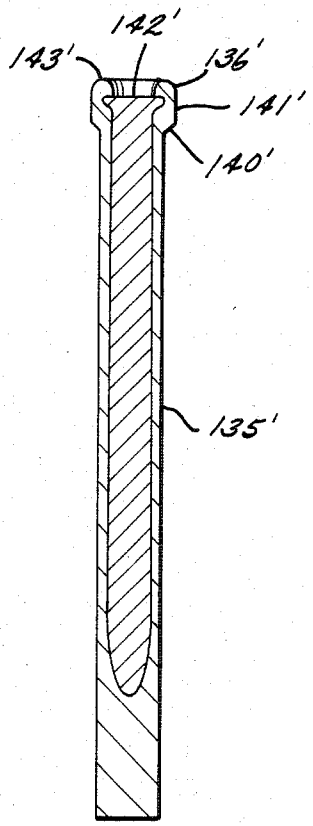
FIG. 23 is a sectional view showing the electrode blank of FIG. 22 after the upper headed portion is reduced in diameter.
Figure 24:
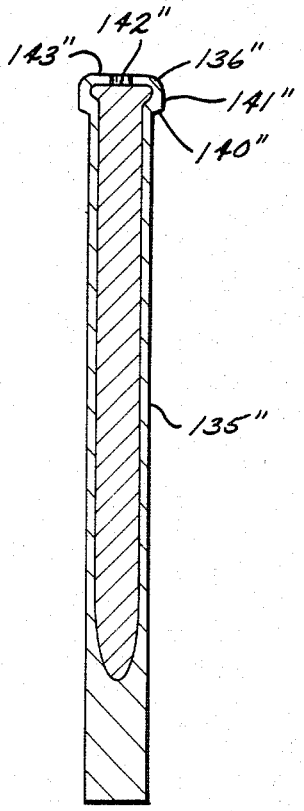
FIG. 24 is a sectional view showing the electrode blank of FIG. 23 after the upper headed portion of reduced diameter is subjected to additional heading.

The method of the invention further involves inserting the closed end 18 of the composite billet 17 into a die indicated at 20 in FIG. 3. The die 20 has a stepped bore 21 including an upper bore 22 in which the composite billet 17 fits closely and an extrusion orifice 23 of reduced diameter relative to the upper bore 22. Pressure is then applied to a plunger 24 to force all except a terminal portion 25 (FIG. 4) of the billet 17 through the extrusion orifice 23. An electrode blank 26 thus formed has the unextruded terminal portion 25 as an upper headed portion, a lower portion 27 of reduced diameter extending longitudinally therefrom, and a copper core 28 extending therein. After the electrode blank 26 is removed from the die 20, it is suitable for use as a composite center electrode for a spark plug. If desired, however, the upper headed portion 25 can be shaped by cold-working or further extrusion into a more desirable electrode head configuration. A series of cold-working and extrusion steps in accordance with the instant invention are described subsequently in connection with FIGS. 22, 23 and 24. An electrode assembly is formed by welding a metal rod (not illustrated) to the upper headed portion 25 of the electrode blank 26.

The wall 12 of the cup 10 of the composite billet 17 (FIG. 2) extends beyond the copper or the like at the filled end 19 thereof. It has been found that, when such a composite billet is extruded as described above with reference to FIGS. 3 and 4, the force applied by the plunger 24 first deforms the wall 12, causing it to thicken inwardly because of its confinement within the upper bore 22 and by the plunger 24. The force required to cause extrusion of the composite billet 17 greatly exceeds that necessary to cause the deformation of the wall 12; as a consequence, the wall deformation occurs before extrusion commences and, during extrusion, the thickened portion of the wall partially confines the copper, forcing it into contact with the closed end of the cup while extrusion is occurring.

In accordance with another embodiment of the instant invention, the wall deformation can be prevented and contact between the copper and the closed end of the cup can be maintained during extrusion by a stud carried on the lower end of the plunger which is used to cause extrusion. This embodiment is described subsequently in connection with FIGS. 20 and 21.

Figure 5:
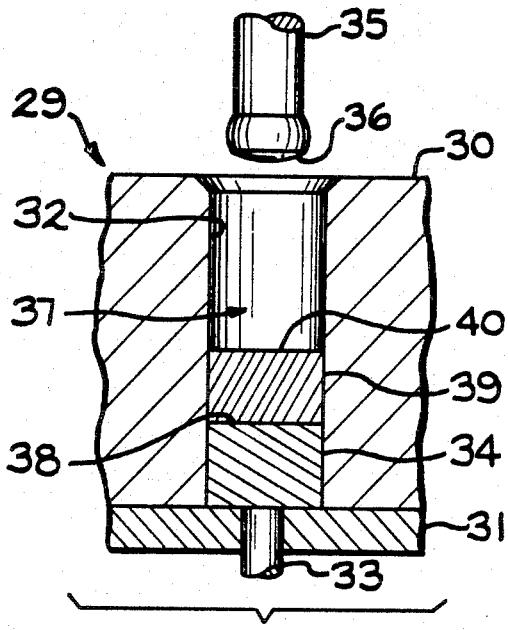
FIG. 5 is a partially schematic, vertical sectional view showing a right circular cylindrical billet of corrosion-resistant metal inserted into a cavity of a die.

The cup 10 can be formed by drilling or back-extruding a billet; the latter, which is preferred, can be carried out in a back-extruder indicated generally at 29 in FIG. 5. The back-extruder 29 comprises a die 30 positioned on a platen 31 and having a right circular bore 32 extending therethrough. The back-extruder 29 also comprises a rod 33 which extends through the platen 31 and carries a floating ejector 34 which closes a lower opening of the bore 32, and a plunger 35 having a diameter less than that of the bore 32 and insertable therein, and having a lower surface 36. A cavity indicated generally at 37 is formed by a wall of the bore 32 and an upper surface 38 of the floating ejector 34.

Figure 6:
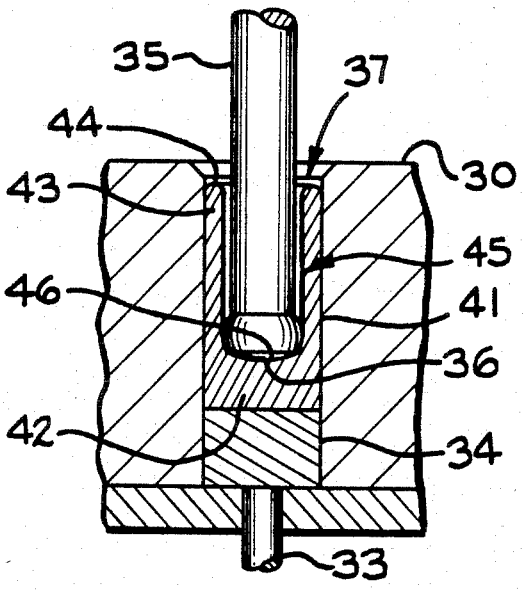
FIG. 6 is a sectional view showing a cup formed by back-extruding the billet of FIG. 5.

A right circular cylindrical billet 39 having an upper end 40, and sized to fit tightly against the wall of the bore 32, is inserted into the cavity 37. Pressure is then applied to drive the plunger 35 into the cavity 37, where it pierces the billet 39 and causes back-extrusion thereof to form a cup 41, FIG. 6. The cup 41 has a closed end 42, a wall 43 extending upwardly from the closed end 42 to an open end 44 and a cavity indicated generally at 45 extending concentrically therein to a lower surface 46 which corresponds to the shape of the lower surface 36 of the plunger 35. The plunger 35 is withdrawn from the cavity 45 of the cup 41 and pressure is applied to the rod 33 to cause the floating ejector 34 to force the cup 41 out of the cavity 37. In accordance with another embodiment of the instant invention, a cup having a circumferential chamfer adjacent the closed end is formed by back extrusion. This embodiment is described subsequently in more detail with reference to FIGS. 18 and 19.

Figure 7:
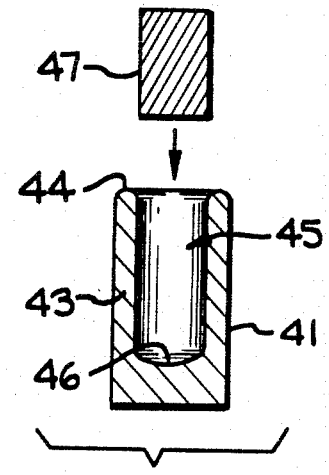
FIG. 7 is a partially schematic, vertical sectional view showing a right circular cylindrical billet of metal of high thermal conductivity prior to being inserted into the cup of FIG. 6.
Figure 8:
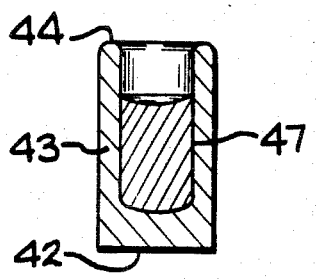
FIG. 8 is a sectional view showing the billet of FIG. 7 inserted into the cup of FIG. 7.

Referring to FIG. 7, a close-fitting right circular cylindrical billet 47 of a metal having a high thermal conductivity, e.g., copper, is inserted, as indicated by an arrow, into the open end 44 of the cup 41, fitting closely within the cup wall 43. The copper billet 47 is compressed within the cavity 45 of the cup 41 into close-fitting relationship with the lower surface 46 thereof, as shown in FIG. 8. The copper billet 47 fits tightly within the cup wall 43 adjacent the closed end 42, but terminates short of the open cup end 44 so that the cup wall 43 extends substantially thereabove at the open end 44.

When the cup 41 containing the recessed copper billet 47 is extruded as described above with reference to FIGS. 3 and 4, the force applied by the plunger 24 deforms a portion of the cup wall 43 radially inwardly. The portion of the wall 43 that is so-deformed extends above the copper billet 47 to the open end 44 of the cup 41. As a consequence of the deformation, the copper billet 47 is substantially confined as the force applied through the plunger 24 increases and causes extrusion of a portion of the cup 41 containing the recessed copper billet 47; as a consequence of this confinement, contact between the billet 47 and the closed end 42 of the cup 41 is maintained during extrusion.

Figure 9:
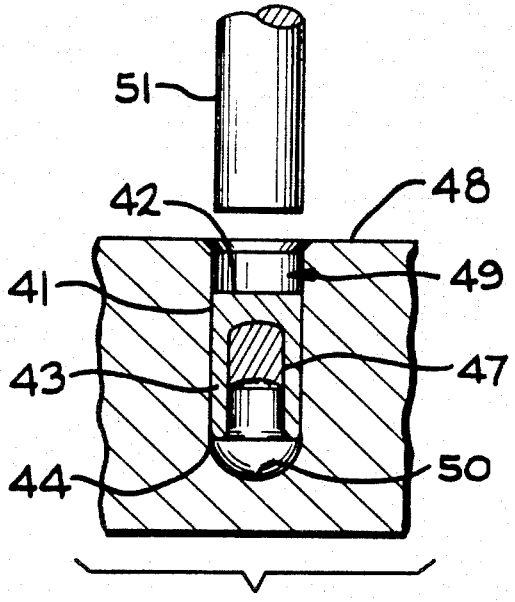
FIG. 9 is a partially schematic, vertical sectional view showing the billet and the cup of FIG. 8 inserted into a cavity of a die in which they are formed into a composite billet.

In accordance with an improvement invented solely by Richard S. Podiak, the cup and core assembly shown in FIG. 8 is subjected to a rolling step prior to extrusion. Referring to FIG. 9, a die indicated at 48 has a cavity 49 extending longitudinally therein to a lower concave surface 50. After the open cup end 44 is inserted into the cavity 49 of the die 48, a plunger 51 is forced against the closed end 42 to roll the cup wall 43 adjacent the open cup end 44 radially inwardly to substantially enclose the billet 47 and to form a composite billet 52 having closed and inwardly turned ends 53 and 54, FIG. 10.

Figure 10:
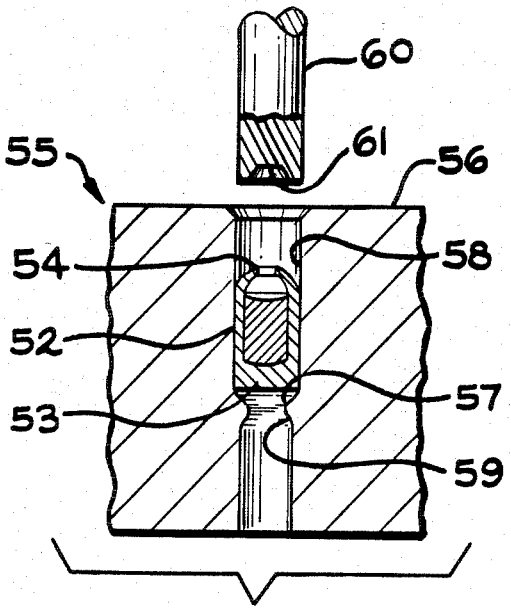
FIG. 10 is a partially schematic, vertical sectional view showing a composite billet formed in the die of FIG. 9, and inserted into the bore of a die having within the bore an extrusion orifice.

The composite billet 52, produced in accordance with the rolling step invented by Podiak, is partially extruded to produce a headed electrode blank wherein the copper is completely encapsulated by the nickel. Referring to FIG. 10, a forward-extruder indicated generally at 55 comprises a die 56 having a stepped bore 57 including an upper bore 58 in which the billet 52 fits closely and an extrusion orifice 59 of reduced diameter relative to the upper bore 58. The forward-extruder 55 also comprises a plunger 60 having a diameter substantially equal to that of the upper bore 58 and insertable therein. After the closed end 53 of the billet 52 is inserted into the upper bore 58 of the die 56, the plunger 60 is forced into the bore 58 so that a surface 61 contacts the inwardly turned end 54 of the billet 52, and all except a terminal portion of the billet 52 is forced through the extrusion orifice 59 of the die 56 to form an electrode blank indicated generally at 62 in FIG. 11. The electrode blank 62 has the unextruded terminal portion of the billet 52 as an upper headed portion 63, a lower portion 64 of reduced diameter extending longitudinally therefrom, and a copper core 65 extending therein. After the electrode blank 62 has been removed from the die 56, it is suitable for use as a composite center electrode for a spark plug. If desired, however, the upper headed portion 63 can be shaped by cold-working, further extruding, or shearing into a more desirable electrode head configuration. A method of shearing, which method was developed by Dieter Path and Paul Biesenkamp, involves the use of a shearing and forming apparatus indicated generally at 66 in FIG. 12, and comprising a die 67 having a stepped bore 68 including a right circular cylindrical upper bore 69 extending to a shearing shoulder 70 of reduced diameter, a central bore below the shearing shoulder 70 and extending to a second shoulder 71, and a lower bore 72 extending from the second shoulder 71 through the die 67. The first step of shearing involves inserting the electrode blank 62 within the stepped bore 68. When the electrode blank 62 is so inserted, the upper headed portion 63 seats on the shearing shoulder 70 and fits closely within the upper bore 69, while the lower portion 64 fits closely within the lower bore 72. The shearing and forming apparatus 66 also includes a plunger 73 having a diameter substantially equal to that of the shearing shoulder 70 and insertable therethrough.

Figure 12:
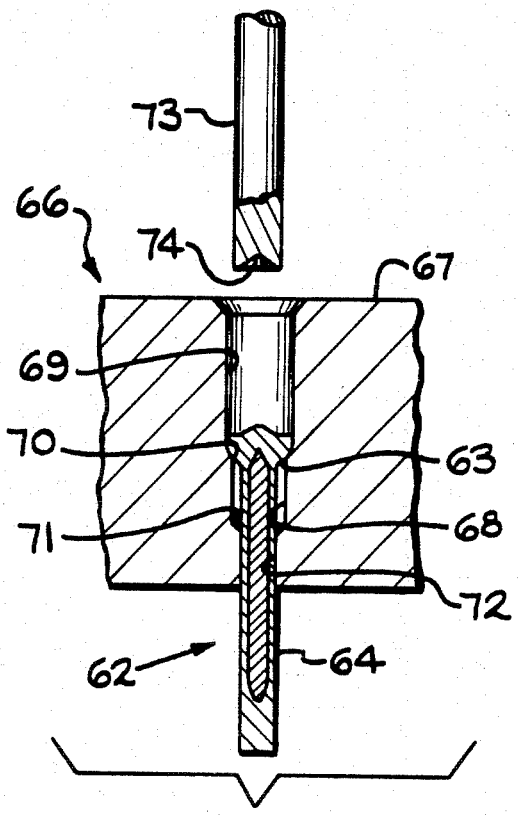
FIG. 12 is a partially schematic, vertical sectional view showing the electrode blank of FIG. 11 positioned in a die having a stepped bore including an upper bore, a shearing shoulder, a second shoulder and a lower bore.
Figure 11:
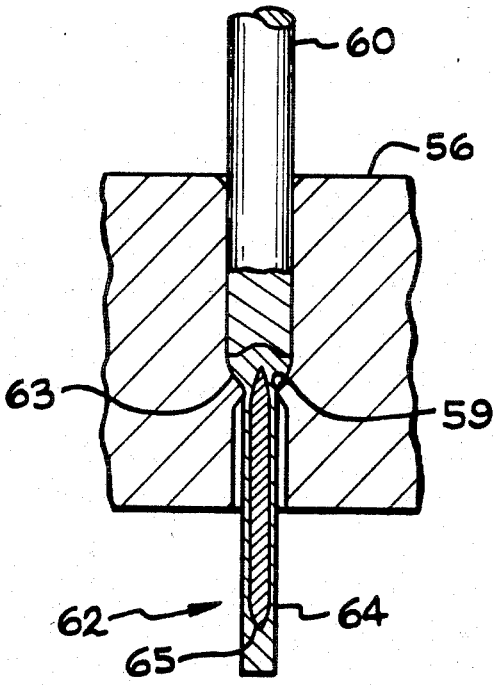
FIG. 11 is a sectional view showing an electrode blank formed from the composite billet of FIG. 10 after all except an upper headed portion thereof is forced through the extrusion orifice.
Figure 13:
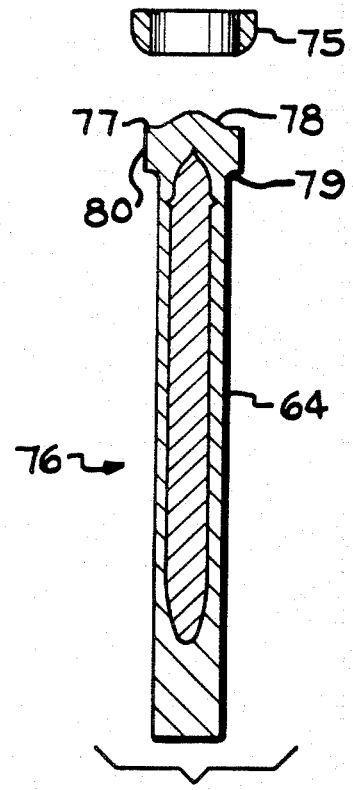
FIG. 13 is a partially schematic, vertical sectional view showing a composite center electrode formed by shearing the upper headed portion of the electrode blank of FIG. 12.

The plunger 73 is advanced concentrically within the upper bore 69 until a lower surface 74 engages the upper headed portion 63 of the electrode blank 62 driving it past the shearing shoulder 70, and against the second shoulder 72 leaving a ring 75 of excess material. This operation forms a desired composite center electrode indicated generally at 76 (FIG. 13). The composite electrode 76 includes a head 77 and the rod 64 of the electrode blank 62 (FIGS. 11 and 12). The electrode head 77 (FIG. 13) has upper and under surfaces 78 and 79 conforming to the shape of the lower surface 74 (FIG. 12) of the plunger 73 and the second shoulder 71 of the die 67, respectively. Although the lower surface 74 of the plunger 73 is illustrated as being concave, it can be of any shape necessary to form the upper surface 78 (FIG. 13) desired for the electrode head 77. The electrode head 77 also has a cylindrical side 80 having a diameter equal to that of the shearing shoulder 70 (FIG. 12) of the die 67. The composite center electrode 76 (FIG. 13) is then removed from the die (FIG. 12) through the upper bore 69 and is suitable for the desired use without further cold-working or extruding steps.

Figure 14:
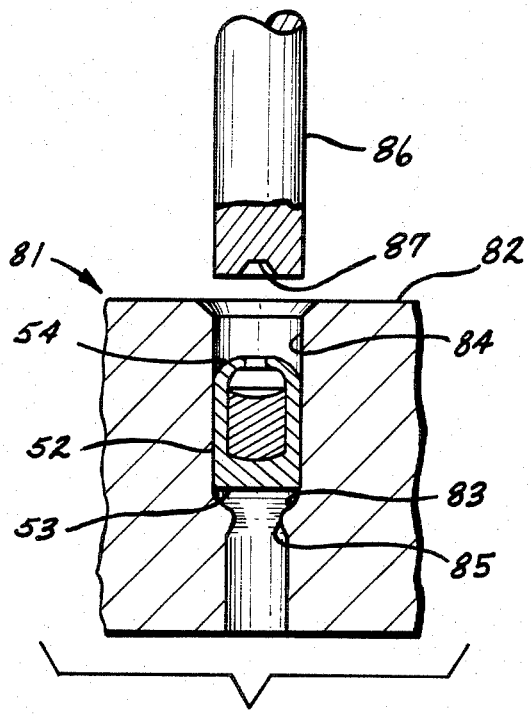
FIG. 14 is a partially schematic, vertical sectional view showing a composite billet formed from the cup and the billet within the cavity of the die of FIG. 9, and inserted into the bore of a die having within the bore an extrusion orifice equal in diameter to that of a desired electrode head.

The instant method includes the additional improvement wherein the entire cup and core assembly, for example, that shown in FIG. 8, is extruded, by tandem extrusion, to produce an unheaded electrode comprising a copper core completely encapsulated by a layer of nickel. Referring to FIG. 14, tandem extrusion can be carried out in a forward-extruder indicated generally at 81 which comprises a die 82 having a stepped bore 83 including an upper bore 84 in which the billet 52 or another billet fits closely and an extrusion orifice 85 of reduced diameter relative to the upper bore 84. The forward-extruder 81 also comprises a plunger 86 having a diameter equal to that of the upper bore 84 and insertable therein, and a lower surface 87. A billet to be "tandem extruded" is inserted into the upper bore 84 of the die 82, closed end first, the billet 52 being shown in FIG. 14, and the plunger 86 is forced into contact with the outer end of the billet and advanced until all except a terminal portion of the billet has been forced through the extrusion orifice 85 of the die 82. The plunger 86 is withdrawn from the die 82, and a second billet (not shown), usually substantially identical to the first billet, is inserted into the upper bore 84, closed end first. The plunger 86 is then forced into contact with the outer end of the second billet, and advanced until the terminal portion of the first billet has been forced through the extrusion orifice to form an elongated composite billet; at this stage, the second billet, at least, has been compressed somewhat, and may have been extruded partially through the orifice 85.

Figure 15:
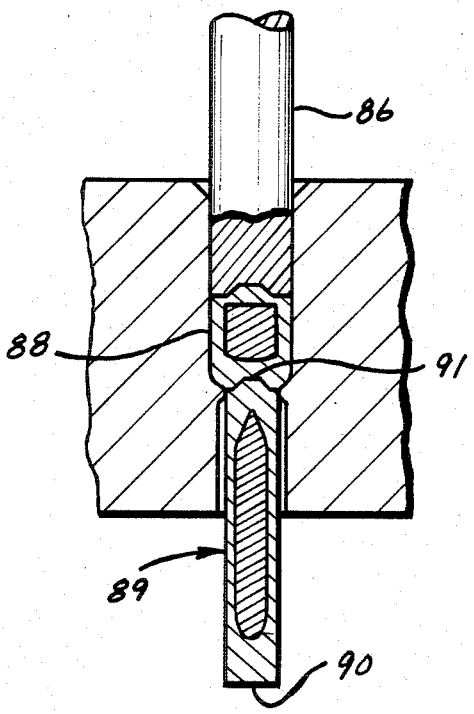
FIG. 15 is a sectional view showing an elongated composite billet formed by forcing the composite billet of FIG. 14 through the extrusion orifice and, thereabove, a second composite billet in a partially deformed condition.

Tandem extrusion, generally, to produce an unheaded electrode comprising a core of copper or the like completely encapsulated by a layer of nickel or the like is a part of the instant invention. For example, the cup and core assembly shown in FIG. 8 can be subjected to tandem extrusion in the extruder 8, and by the process described above with reference to FIGS. 14 and 15. Before extrusion commences, the force applied by the plunger 86 first deforms the wall 43 (FIG. 8) at the open end 44, causing it to thicken inwardly because of its confinement within the upper bore 84 (FIG. 14) and by the plunger 86. The force required to cause extrusion of the composite billet greatly exceeds that necessary to cause the deformation of the wall; as a consequence, the wall deformation occurs before extrusion commences and, during extrusion, the thickened portion of the wall partially confines the copper, forcing it into contact with the closed end of the cup while extrusion is occurring. The product of this method is an unheaded electrode which is similar to the elongated composite billet 89 (FIG. 15), and comprises a core of copper completely encapsulated by nickel.

Figure 16:
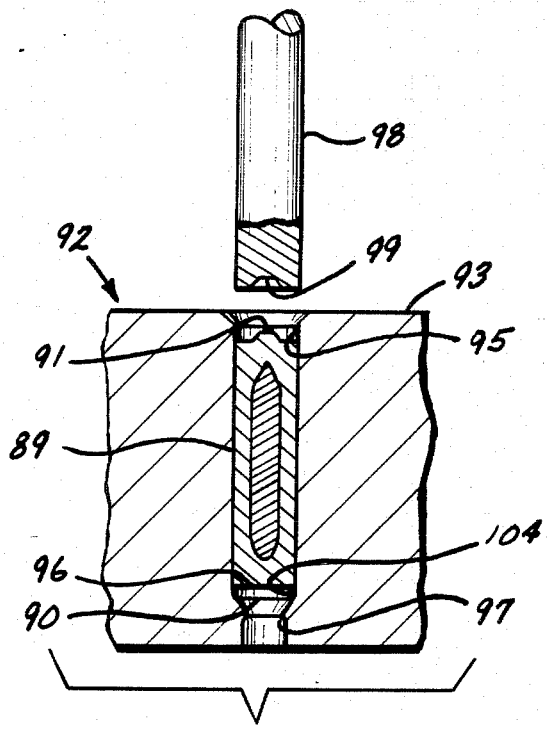
FIG. 16 is a partially schematic, vertical sectional view showing the elongated composite billet of FIG. 15 inserted into the bore of a die having within the bore an extrusion orifice.
Figure 17:
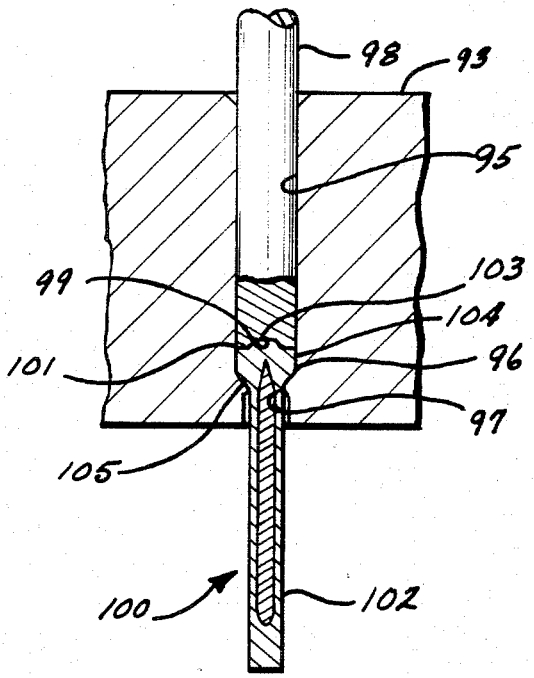
FIG. 17 is a sectional view showing a composite center electrode formed from the elongated billet of FIG. 16 after all except an upper headed portion thereof is forced through the extrusion orifice.

The specific embodiment of tandem extruding the billet 52 was invented by Podiak, as was a method for partially extruding the elongated composite billet 89 to produce a headed composite center electrode. That method, referring to FIGS. 16 and 17, is carried out in a forward-extruder indicated generally at 92 which comprises a die 93 having a stepped bore 94 including an upper bore 95 extending to a shoulder 96, and an extrusion orifice 97 of reduced diameter adjacent and below the shoulder 96. The forward-extruder 92 also comprises a plunger 98 having a diameter substantially equal to that of the upper bore 95. After the closed end 90 of the elongated billet 89 is inserted into the upper bore 95 of the die 93, a lower surface 99 of the plunger 98 is forced into contact with the filled end 91 of the elongated billet 89. Referring to FIG. 17, the plunger 98 is advanced until all except a terminal portion of the elongated billet 89 has been forced through the extrusion orifice 97 of the die 93 to form a composite center electrode indicated generally at 100. The composite center electrode 100 has the unextruded terminal portion of the elongated billet 89 as a head 101, and a rod 102 extending longitudinally therefrom. The electrode head 101 has an upper surface 103 conforming to the shape of the lower surface 99 of the plunger 98, a cylindrical side 104 having a diameter equal to that of the upper bore 95 of the die 93, and an under surface 105 conforming to the shape of the shoulder 96. Although the lower surface 99 of the plunger 98 is illustrated as being concave, it can be of any shape necessary to form the upper surface 103 desired for the electrode head 101. The composite center electrode 100 is then removed from the die 93 through the upper bore 95 and is suitable for the desired use without further cold-working or extruding steps.

Figure 18:
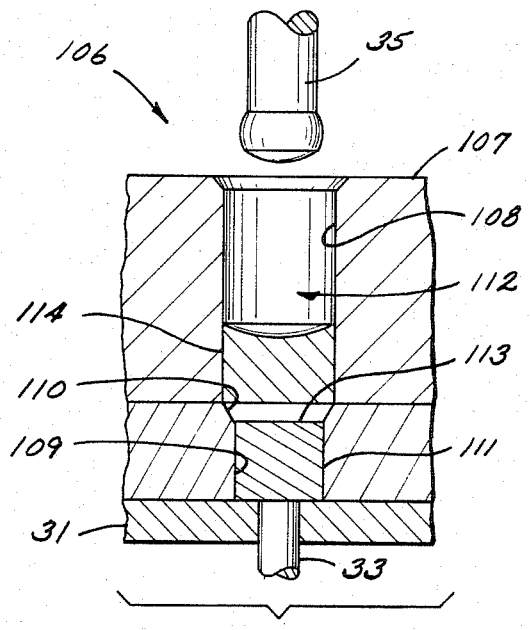
FIG. 18 is a sectional view showing a billet inserted into a cavity of a die wherein the cavity has closed and open ends and a chamferred surface adjacent to the closed end thereof.
Figure 19:
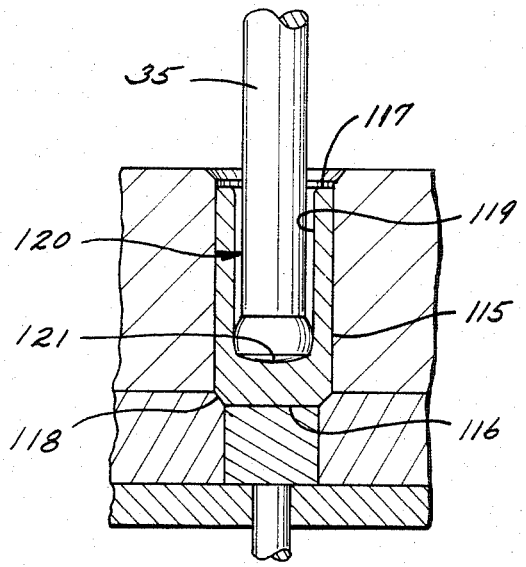
FIG. 19 is a sectional view showing the billet of FIG. 18 after being pierced and back-extruded to form a cup having closed and open ends, a chamferred edge adjacent to the closed end thereof, and a cavity extending concentrically therein.

Referring to FIG. 18, another back-extruder indicated generally at 106 is similar to the back-extruder 29 in FIG. 5, comprising a composite die 107 positioned on the platen 31. The composite die 107 has a right circular upper bore 108, a lower bore 109 of reduced diameter extending therein and a chamferred shoulder 110 extending therebetween. The rod 33 extends through the platen 31 carrying a floating ejector 111 which fills the lower bore 109. The plunger 35 is of smaller diameter than and insertable into the upper bore 108. A cavity indicated generally at 112 is formed by the wall of the upper bore 108, an upper surface 113 of the floating ejector 111, and the wall of the chamferred shoulder 110 extending therebetween. In this embodiment of the instant invention, a billet 114 is sized to fit tightly against the wall of the upper bore 108 and is seated on the chamferred shoulder 110. The plunger 35 is inserted into the cavity 112. As shown in FIG. 19, the plunger 35 pierces the billet 114 (See FIG. 18) to form a cup 115 having closed and open ends 116 and 117, a chamferred edge 118 adjacent to the closed end 116 thereof, a wall 119 and a cavity indicated generally at 120 extending concentrically therein to a lower concave surface 121.

Figure 20:
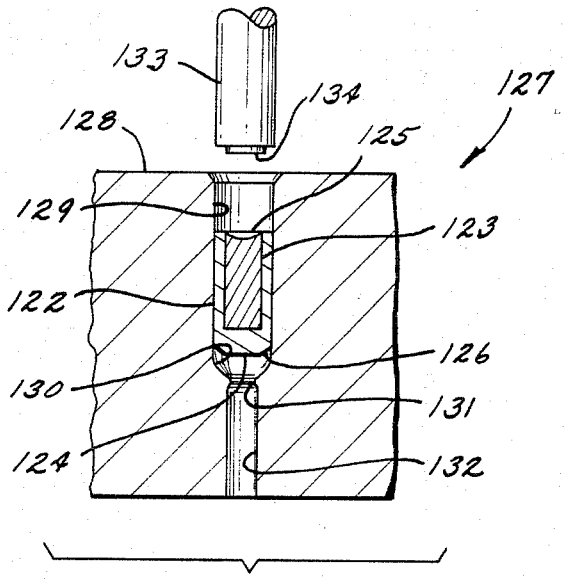
FIG. 20 is a partially schematic, vertical sectional view showing a composite billet inserted, closed end first, into the close-fitting bore of a die having within the bore an extrusion orifice.

Referring to FIG. 20, a composite billet indicated generally at 122 is formed by inserting a right circular cylindrical billet 123 of a metal having a high thermal conductivity into the open end 117 of the cup 115 (see FIG. 19). In the preferred embodiment, the billet 123 is copper and is compressed within the cavity 120 of the cup 115. The composite billet indicated generally at 122 in FIG. 20 has closed and filled ends 124 and 125 and a chamferred edge 126 adjacent to the closed end 124 thereof. The purpose of the chamferred edge 126 is to guide the composite billet 122 as it is forced through a forward-extruder. Hence, the chamferred edge 126 can be of any other configuration adequate to accomplish that purpose.

Another embodiment of the step of forward extrusion discussed above in connection with FIGS. 3 and 4, can be carried out in a forward-extruder indicated generally at 127 in FIG. 20. The extruder 127 comprises a die 128 having a right circular cylindrical upper bore 129 extending therein to a concave shoulder 130 which forms an extrusion orifice 131 of reduced diameter relative to the upper bore 129, and a lower bore 132 extending therebelow. The upper bore 129 has a diameter sufficiently large to receive the composite billet 122 in close-fitting relationship. The forward-extruder 127 also comprises a plunger 133 having a diameter substantially equal to that of the upper bore 129, and a stud 134 extending concentrically from a lower end thereof. The stud 134 has a diameter equal to that of the copper billet 123 and a depth no greater than one half the diameter thereof.

Figure 21:
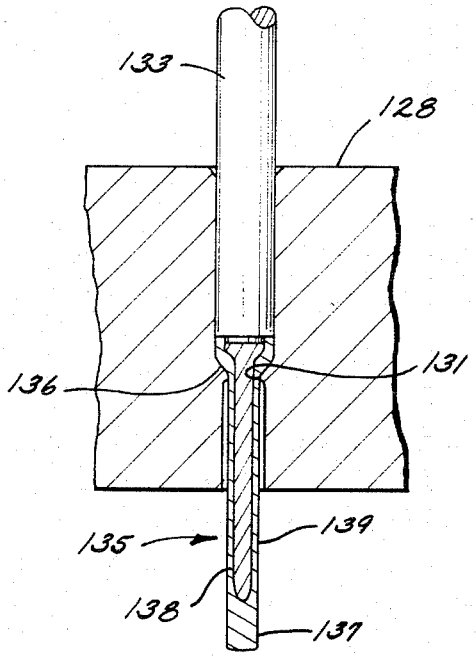
FIG. 21 is a sectional view showing the composite billet of FIG. 20 after a plunger is inserted into the bore of the die against the filled end of the composite billet and after pressure is applied to the plunger to force all the composite billet except a terminal portion adjacent to the filled end thereof through the extrusion orifice to form an electrode blank having the unextruded terminal portion as an upper headed part.

As shown in FIG. 20, the closed end 124 of the composite billet 122 is inserted into the upper bore 129 of the die 128. The plunger 133 is then advanced into contact with the filled end 125 of the composite billet 122. Referring to FIG. 21, the plunger 133 is advanced to force all of the composite billet 122 except a terminal portion adjacent to the filled end 125 thereof through the extrusion orifice 131 of the die 128 to form an electrode blank indicated generally at 135. The blank 135 has the unextruded terminal portion as an upper headed portion 136 and a rod 137 of reduced diameter extending longitudinally therefrom as a lower portion of a diameter equal to that of the extrusion orifice 131 and a length greater than that of the composite billet 122 (See FIG. 20). The electrode blank 135 is then removed from the die 128 through the upper bore 129 thereof.

During the extrusion step described above in connection with FIGS. 20 and 21, the stud 134 enters the open end 125 of the composite billet 122 and prevents deformation of the wall 119 while forcing the copper core 123 into contact with the closed end 116 of the cup 115. This is in contrast to the extrusion step described above in connection with FIGS. 3 and 4 wherein the extrusion force, applied by a flat-ended plunger 24, causes the wall 12 to deform radially inwardly.

Figure 22:
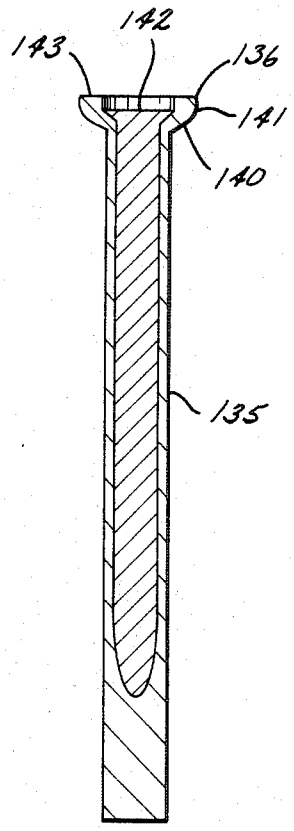
FIG. 22 is a partially schematic, vertical sectional view showing the electrode blank of FIG. 21.

The rod 137 of the electrode blank 135 has a core 138 within a shell 139. The diameter of the core 138 and the thickness of the wall of the shell 139 are sufficiently uniform to assure uniform heat conductivity. Even though the electrode blank 135 is suitable for use as a composite spark plug electrode, a specific application sometimes necessitates the additional step of shaping the upper headed portion 136 of the electrode blank 135 into a more desirable electrode head configuration. For example, as shown in FIG. 22, the upper headed portion 136 of the electrode blank 135 comprises an under head 140 formed by the concave surface of the shoulder 130 of the die 128, a side head 141 formed by the wall of the upper bore 129 of the die 128, and a recessed upper core surface 142 of copper concentric within a stepped lip 143 of nickel and formed by the stud 134 extending from the lower surface of the plunger 133 (See FIGS. 20 and 21).

In one embodiment of the instant invention, the side head 141 (FIG. 22) of the upper headed portion 136 of the electrode blank 135 is reduced in diameter by cold working to form an upper headed portion 136' (FIG. 23) of an electrode blank 135' having a chamferred under head 140' of reduced diameter, a side head 141' of reduced diameter and increased height, and a recessed upper core surface 142' of reduced diameter concentric with a rounded lip 143' of reduced diameter.

The under head 140' and the rounded lip 143' of the upper headed portion 136' are then flattened to form an upper headed portion 136" (FIG. 24) of a composite spark plug electrode 135" having a chamferred under head 140" of a reduced angle, a side head 141" of reduced height, and a recessed upper core surface 142" of reduced diameter concentric with a round lip 143" flattened to cover most of the upper core surface 142". The composite spark plug electrode 135" is now suitable for the specific application referred to above.

It will be apparent that various changes may be made in details of construction from those shown in the attached drawings and discussed in conjunction therewith without departing from the spirit and scope of this invention as defined in the appended claims. It is, therefore, to be understood that this invention is not to be limited to the specific details shown and described.

We claim:

1. A method of forming a bimetal center electrode, said method comprising forming a first metal into a cup having an open end, a closed end and a wall surrounding a central opening which extends a distance Z from the closed end to the open end, forming a right circular cylindrical core from a second and different metal, said core being sized to be received in the central opening in close fitting relationship with the wall therearound, and extending from the closed end toward the open end a distance less than Z, positioning said core in said central opening thereby forming a composite billet having first and second ends corresponding, respectively, with the open and closed ends of the cup, deforming the cup wall at the first end of the composite billet radially inwardly to close the cup wall at least partially around the right circular cylindrical core, extruding a portion of the composite billet, second end first, through an extrusion orifice of a die with a force applied to the first end of the composite billet by an end of a tool, said force being applied so as to maintain substantial contact between said core and said closed end of the cup while said extrusion is occurring.

2. A method as claimed in claim 1 wherein, prior to the deforming step but after the composite billet has been formed, the cup and the right circular cylindrical core are forced into close fitting engagement.

3. A method of forming bimetal electrodes for spark plugs or the like, comprising forming a first metal into a cup having a cylindrical wall, a central opening therein, said central opening extending from an open end to a closed end, forming a core from a second and different metal, positioning said core in said central opening with said core recessed back from said open end, deforming the wall of said cup adjacent to said open end inwardly to close said open end at least partially around said core, and simultaneously extruding said core and cup by applying a force against said partially closed open end, said force in addition to causing said extrusion also closing said open end to substantially encapsulate said core.

4. A method as claimed in claim 3 wherein, prior to extruding, said cup and said core are forced into close fitting engagement.

5. A method of forming a bimetal electrode having a shank of substantially constant diameter Y extending from a first end to an opposed, radially enlarged head having a diameter of X where Y is less than X, said method comprising backward-extruding a slug of a first metal to form a cup having a diameter greater than X, a closed end, an open end and a tubular portion with a central cavity therein extending a distance of Z from said open end to said closed end, forming a cylindrical core having a length less than Z and a diameter substantially equal to but not greater than that of the central opening from a different metal, inserting the cylindrical core into said central opening to form a composite billet wherein said core does not project beyond said open end, pressing a portion of said composite billet through an extrusion orifice of a die, closed end first, terminating said extrusion while a portion of said cup remains unextruded having a diameter greater than X and reducing the diameter thereof to X.

6. A method as claimed in claim 5 wherein, after the composite billet has been formed but prior to the extrusion step, the tubular portion adjacent the filled end of the cup is deformed radially inwardly to close the tubular portion at least partially around the cylindrical core.

7. An electrode for spark plugs or the like, comprising a core formed of one metal, such as copper or the like, and an outer surface of a second and different metal completely encapsulating said core, said electrode being formed by simultaneous extrusion of said core metal and second metal by a force applied to the inturned end of a cup of said second metal which fully closes said inturned end and maintains substantial contact between said closed end of said cup and said core.

8. A method of forming a bimetal center electrode, said method comprising forming a first metal into a cup having an open end, a closed end and a wall surrounding a central opening which extends a distance z from the closed end to the open end, forming a right circular cylindrical core from a second and different metal, said core being sized to be received in the central opening in close fitting relationship with the wall therearound, and extending from the closed end toward the open end a distance less than z, positioning said core in said central opening thereby forming a composite billet having first and second ends corresponding, respectively, with the open and closed ends of the cup, and extruding a portion of the composite billet, second end first, through an extrusion orifice of a die with a force applied to the first end of the composite billet by an end of a tool, said force being applied so as to maintain substantial contact between said core and said closed end of the cup while said extrusion is occurring.

9. An electrode for spark plugs or the like, comprising a core formed of one metal, such as copper or the like, and an outer surface of a second metal at least partially encapsulating said core, said electrode being formed by partially extruding a composite produced by seating the core metal within a cup shaped body of said second metal having open and closed ends, said composite being partially extruded, closed cup end first, through an extrusion die while simultaneously maintaining substantially complete contact between said closed cup end and the core metal and shaping the unextruded open end of the cup to encapsulate the core at least partially.

10. A method as set forth in claim 8, wherein, at the completion of the extrusion operation, a part is produced having a shank and an enlarged head at the end thereof opposite said closed end, and thereafter the diameter of said head is reduced.

11. A method as claimed in claim 8 in which the first metal is formed into the cup by a back-extrusion step.

12. A method as claimed in claim 8 or 11 in which the first metal is nickel or nickel alloy and the second metal is copper or copper alloy.

13. A method as claimed in claim 8 wherein, prior to extrusion, the right circular cylindrical core and the cup wall are forced into close fitting engagement.

14. A method as claimed in claim 8, 10, 11 or 13 which includes the additional step of shaping the unextruded portion of the center electrode into a desired electrode head configuration after extrusion.

15. A method as claimed in claim 13 wherein the step of forcing the right circular cylindrical core and the cup wall into close fitting engagement is carried out by urging the former into the cavity of the cup and into contact with the wall and the closed end of the cup.

16. A method as claimed in claim 8, 11, 13 or 15 wherein the end of the tool carries a stud which has a diameter substantially equal to that of the right circular cylindrical core.

17. A method of forming bimetal electrodes for spark plugs or the like, said method comprising forming a first metal into a cup having a cylindrical wall and a central opening therein, said central opening extending from an open end to a closed end, forming a core from a second and different metal, positioning said core in said central opening to form a composite billet having first and second ends corresponding with the open and closed ends of the cup, wherein said core is recessed back from said open end, extruding all of said composite billet, second end first, by applying a force against the first end thereof, said force in addition to causing said extrusion also closing said open end to encapsulate said core fully.

18. A method as claimed in claim 17 wherein, prior to extrusion, said cup and said core are forced into close fitting engagement.

19. A method of forming a bimetal center electrode, said method comprising forming a first metal into a cup having an open end, a closed end and a wall surrounding a central opening which extends a distance z from the closed end to the open end, forming a right circular cylindrical core, having first and second ends, from a second and different metal, said core being sized to be received in the central opening in close fitting relationship with the wall therearound, and extending from the closed end toward the open end a distance less than z, positioning said core in said central opening, first end first, thereby forming a composite billet having first and second ends corresponding, respectively, with the open and closed ends of the cup, and extruding a portion of the composite billet, second end first, through an extrusion orifice of a die by applying a force through an end of a tool to the first end of the composite billet, said force being applied so as to maintain substantial contact between said core and said closed end of the cup while said extrusion is occurring and said force being applied so as to cause a portion of the first metal to cover a portion of the second end of the core.

20. A method as claimed in claim 19 wherein, prior to the extrusion step but after the composite billet has been formed, the cup and the right circular cylindrical core are forced into close fitting engagement.

21. A method as claimed in claim 19 in which the first metal is formed into the cup by a back-extrusion step.

22. In a method for forming bimetal electrodes for spark plugs or the like, which method comprises the steps of forming a first metal into a cup having a cylindrical wall and a central opening therein, said central opening extending from an open end to a closed end, forming a core from a second and different metal, positioning said core in said central opening to form a composite billet having first and second ends corresponding with the open and closed ends of the cup, wherein said core is recessed back from said open end, extruding all of said composite billet, second end first, by applying a force against the first end thereof, said force in addition to causing said extrusion also closing said open end to encapsulate said core fully, the improvement wherein said composite billet is extruded through an extrusion die and wherein, prior to insertion of the composite billet therein, the cup wall adjacent the open cup end is rolled radially inwardly to at least partially enclose said core.

23. In a method as claimed in claim 22, the further improvement wherein said extrusion die contains an extrusion orifice which has a diameter equal to that of a desired electrode head and wherein, after all of said composite billet is extruded, the extruded composite billet is partially extruded to produce a headed bimetal electrode.

* * * * *